US011047137B1

(12) United States Patent
Roche et al.

(10) Patent No.: US 11,047,137 B1
(45) Date of Patent: Jun. 29, 2021

(54) MODULAR ATTIC WALKWAY SYSTEM

(71) Applicants: Patrick Roche, Waddell, AZ (US); Jeff Verhasselt, Waddell, AZ (US)

(72) Inventors: Patrick Roche, Waddell, AZ (US); Jeff Verhasselt, Waddell, AZ (US)

( * ) Notice: Subject to any disclaimer, the term of this patent is extended or adjusted under 35 U.S.C. 154(b) by 0 days.

(21) Appl. No.: 16/775,923

(22) Filed: Jan. 29, 2020

(51) Int. Cl.
*E04F 15/02* (2006.01)

(52) U.S. Cl.
CPC .. *E04F 15/02177* (2013.01); *E04F 15/02022* (2013.01); *E04F 2201/0138* (2013.01); *E04F 2201/035* (2013.01); *E04F 2203/00* (2013.01)

(58) Field of Classification Search
CPC ..... E04F 15/02177; E04F 15/02022; E04F 2201/0138; E04F 2201/035; E04F 2203/00; E04F 15/02452; E04G 3/22; E04G 7/28; E04B 5/43
USPC ..... 52/650.3, 177, 474, 506.01, 506.03, 52/506.05, 506.09, 506.1, 512, 578, 52/590.1, 591.5, 591.1; 182/222
See application file for complete search history.

(56) References Cited

U.S. PATENT DOCUMENTS 3,628,628 A * 12/1971 Gilbreath ..... E04G 1/152 182/222
4,953,501 A * 9/1990 Moreau ..... A01K 1/0151 119/528
5,806,270 A * 9/1998 Solano ..... E04F 15/02 52/181
6,968,652 B1 11/2005 Eadie
8,015,761 B2 * 9/2011 Wainland ..... A47B 13/003 52/177
8,161,690 B1 4/2012 Borne
8,733,059 B1 5/2014 Hamra
8,769,899 B2 * 7/2014 Barry ..... E04F 15/02452 52/480
D732,208 S 6/2015 Matchung
9,097,005 B2 * 8/2015 Cave ..... E04B 5/43
9,206,602 B2 * 12/2015 Cave ..... E04F 15/02044
9,435,113 B2 * 9/2016 Brandt ..... E04B 5/43
9,732,522 B2 * 8/2017 Brandt ..... E04B 1/40
10,125,504 B1 11/2018 Allen
2005/0016098 A1 * 1/2005 Hahn ..... E04C 2/427 52/384
2007/0028550 A1 * 2/2007 Clapper ..... E04G 3/26 52/650.3
2011/0283644 A1 * 11/2011 Barry ..... E04F 15/02452 52/480

(Continued)

*Primary Examiner* — Brent W Herring

(57) ABSTRACT

A modular attic walkway system for creating a walkway across attic joists which includes a plurality of attic joists each has a top face. A plurality of platforms is removably attached to the top faces such that each platform traverses between adjacent attic joists. Each of the platforms is releasably interlocked with an adjacent one of the platforms. Each platform includes a panel. The panel has a top surface, a bottom surface, and a perimeter surface which extends between the top and bottom surfaces. The perimeter surface includes a first mating edge, a second mating edge, a first lateral edge, and a second lateral edge. The first mating edge includes a tongue cutout which extends inwardly from the first mating edge toward the second mating edge. A tongue extension extends outwardly away from the second mating edge and releasably interlocks with a tongue cutout of an adjacently positioned panel.

14 Claims, 5 Drawing Sheets

(56) References Cited

U.S. PATENT DOCUMENTS

| | | | | |
|---|---|---|---|---|
| 2012/0110944 | A1* | 5/2012 | Hess | E04F 15/02183 52/582.1 |
| 2013/0133282 | A1* | 5/2013 | Cave | E04B 5/48 52/650.1 |
| 2013/0239492 | A1* | 9/2013 | Cave | E04F 15/02452 52/126.5 |
| 2013/0313046 | A1* | 11/2013 | Birk | E04G 3/26 182/222 |
| 2014/0318895 | A1 | 10/2014 | Birk | |
| 2015/0337531 | A1* | 11/2015 | Cave | E04B 5/12 52/220.5 |

* cited by examiner

MODULAR ATTIC WALKWAY SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to attic walkway systems and more particularly pertains to a new attic walkway system for creating a walkway across attic joists. The modular attic walkway system allows a semi-permanent or permanent walkway to be placed across attic joists to allow safe traverse. Each of the modular panels interlock with adjacent ones thereof to secure and extend the walkway as needed.

(2) Description of Related Art Including Information Disclosed Under 37 CFR 1.97 and 1.98

The prior art relates to attic walkway systems. Some systems include pre-attached segments that can be rolled out or unhinged to extend across the attic joists.

BRIEF SUMMARY OF THE INVENTION

An embodiment of the disclosure meets the needs presented above by generally comprising a plurality of attic joists each has a top face. A plurality of platforms is removably attached to the top faces such that each of the platforms traverses an open space positioned between adjacent ones of the attic joists. Each of the platforms is releasably interlocked with an adjacent one of the platforms. Each of the platforms include a panel. The panel has a top surface, a bottom surface, and a perimeter surface which extends between the top surface and the bottom surface. The top surface is textured to improve traction. The perimeter surface includes a first mating edge, a second mating edge, a first lateral edge, and a second lateral edge. The first mating edge includes a tongue cutout which extends inwardly from the first mating edge toward the second mating edge. A tongue extension extends outwardly away from the second mating edge and releasably interlocks with an adjacent tongue cutout of an adjacently positioned one of the panels.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
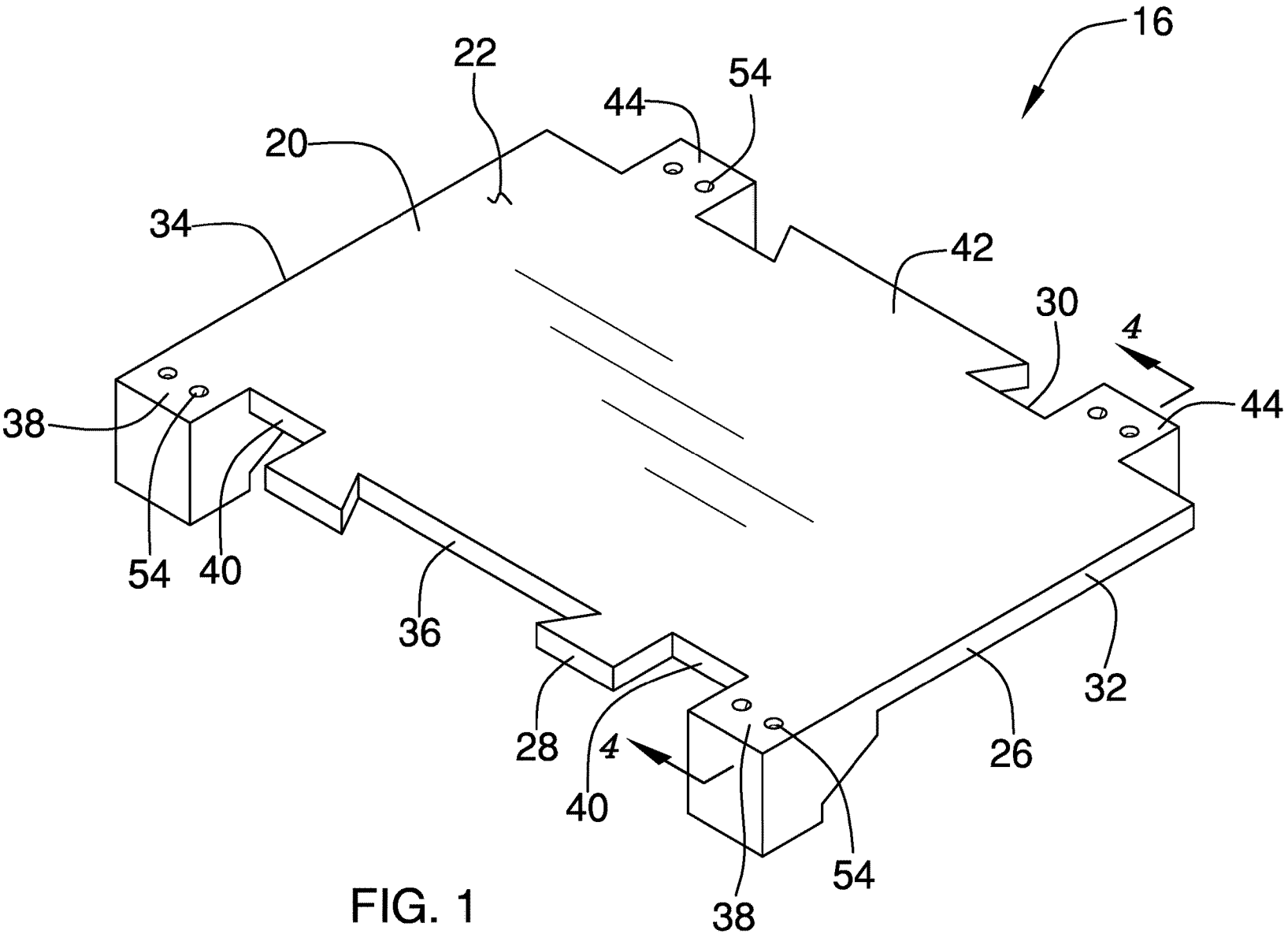
FIG. 1 is a top front isometric view of a modular attic walkway system panel according to an embodiment of the disclosure.
Figure 2:
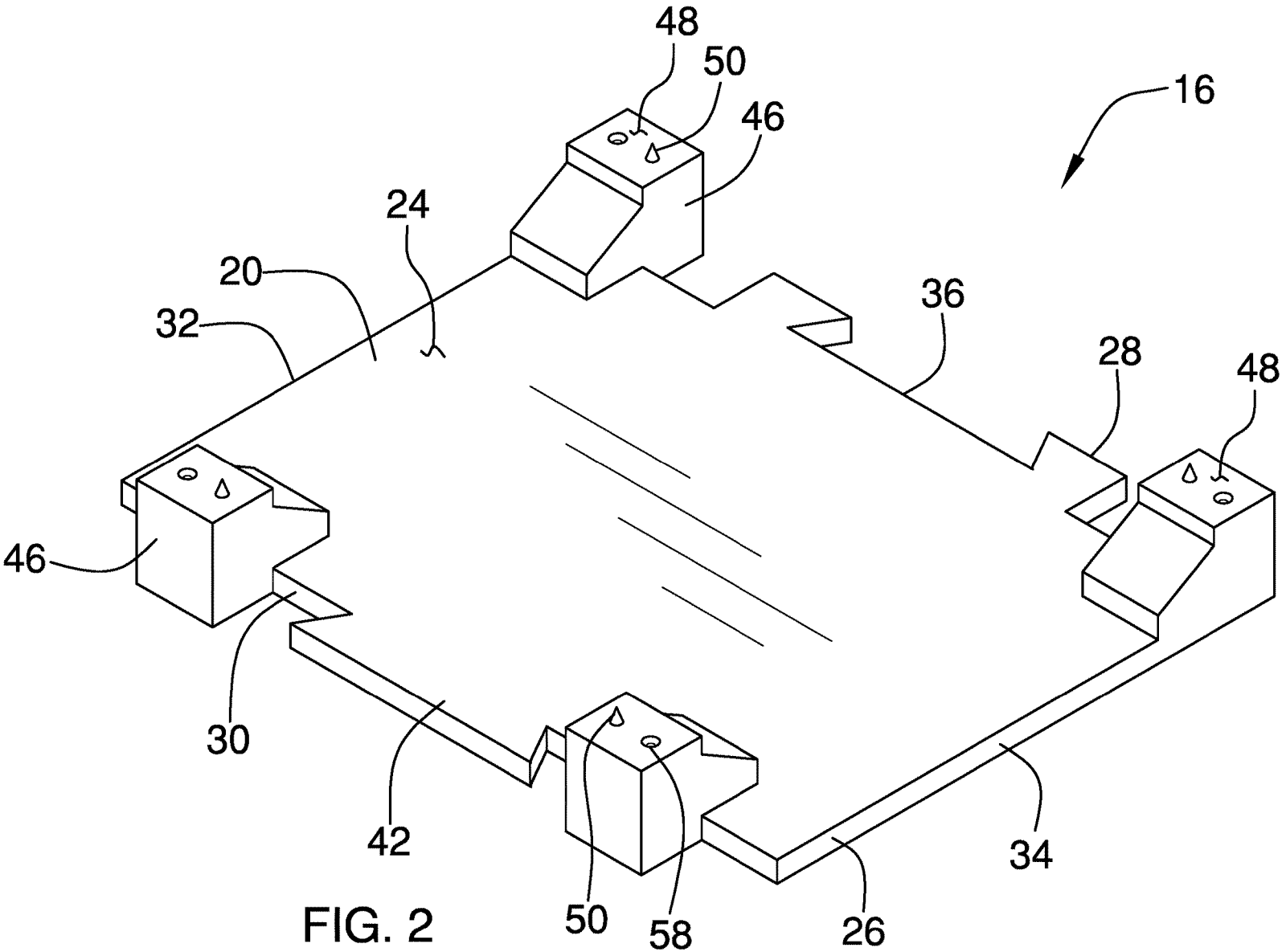
FIG. 2 is a rear bottom isometric view of a panel from an embodiment of the disclosure.
Figure 3:
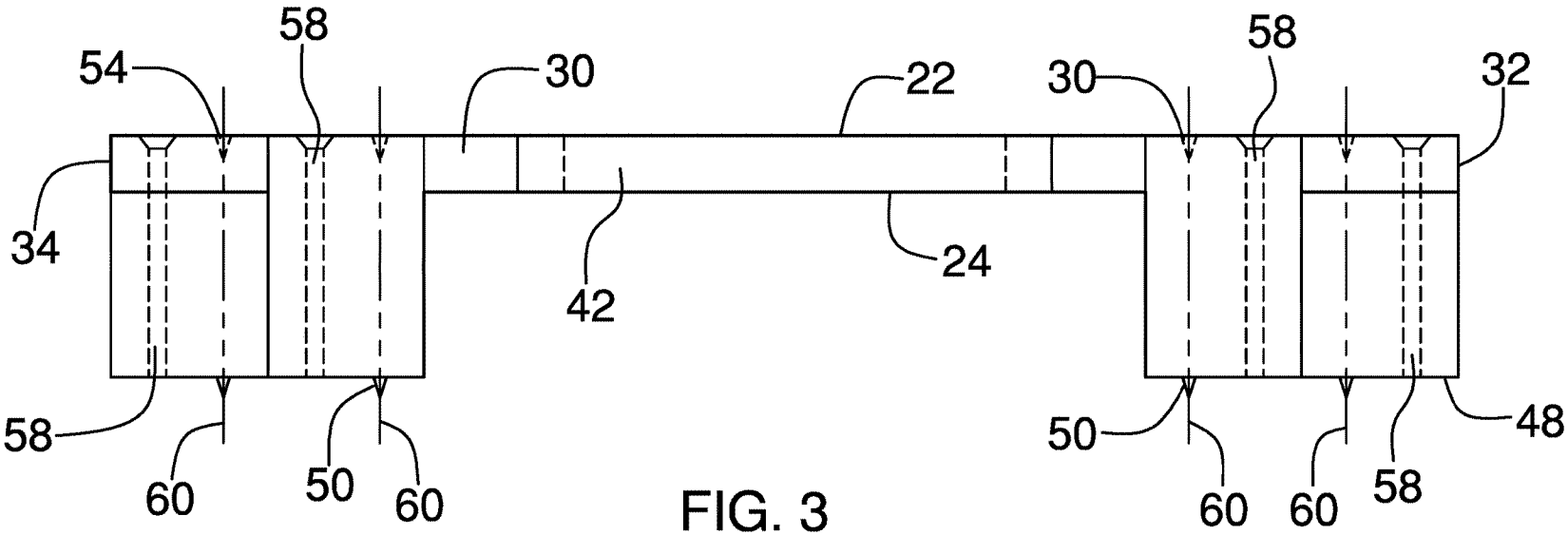
FIG. 3 is a rear side view of a panel from an embodiment of the disclosure.
Figure 4:
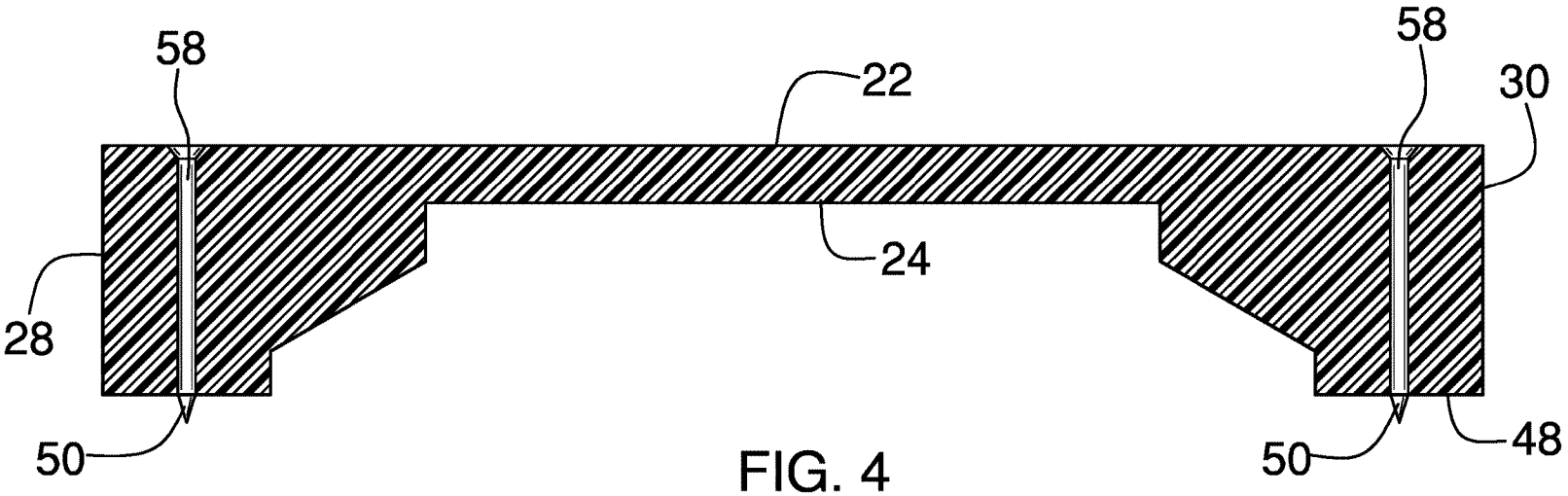
FIG. 4 is a side section view of a panel from an embodiment of the disclosure if segmented about line 4-4 in FIG. 1.
Figure 5:
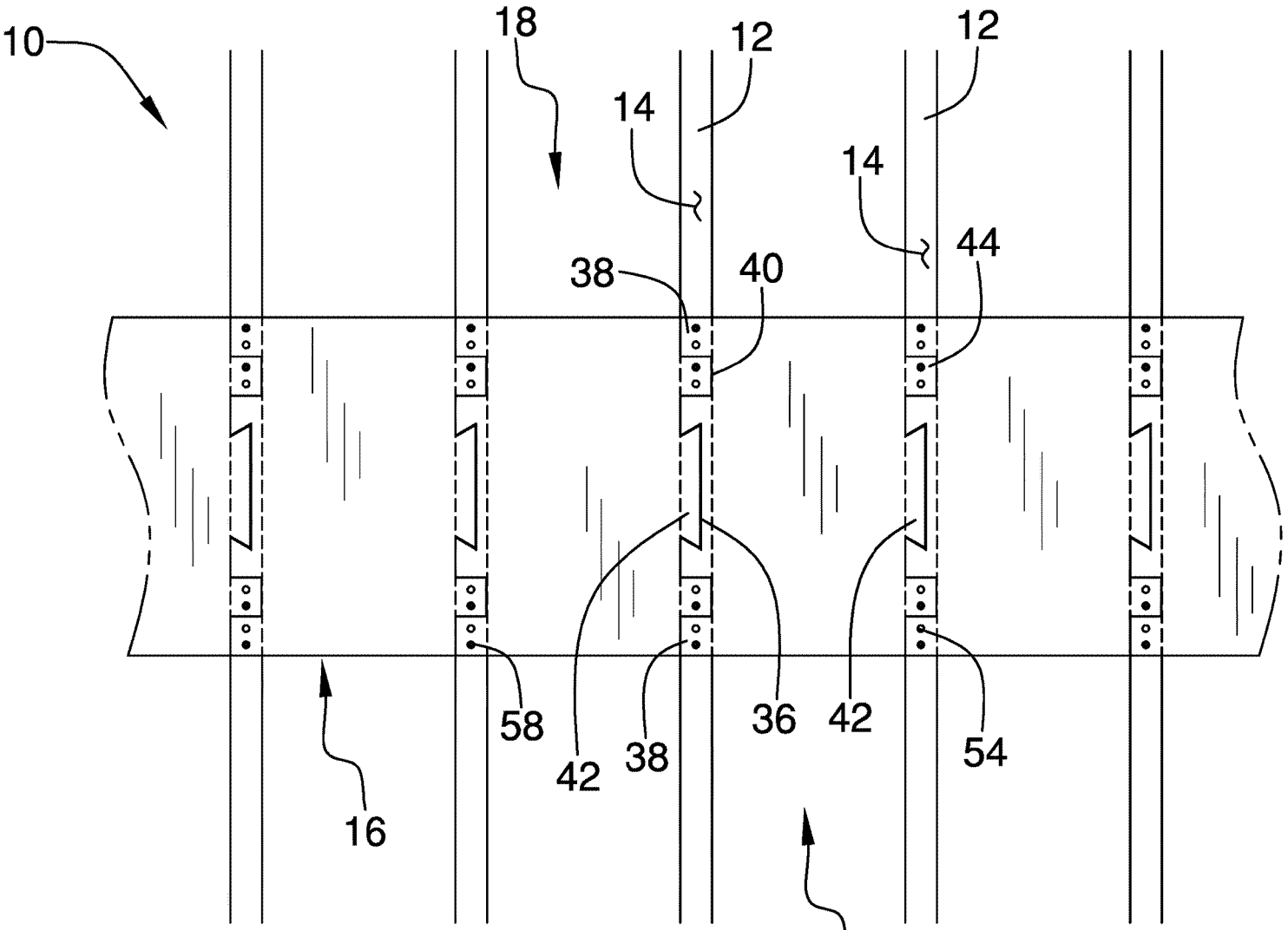
FIG. 5 is a top in-use view of an embodiment of the disclosure.
Figure 6:
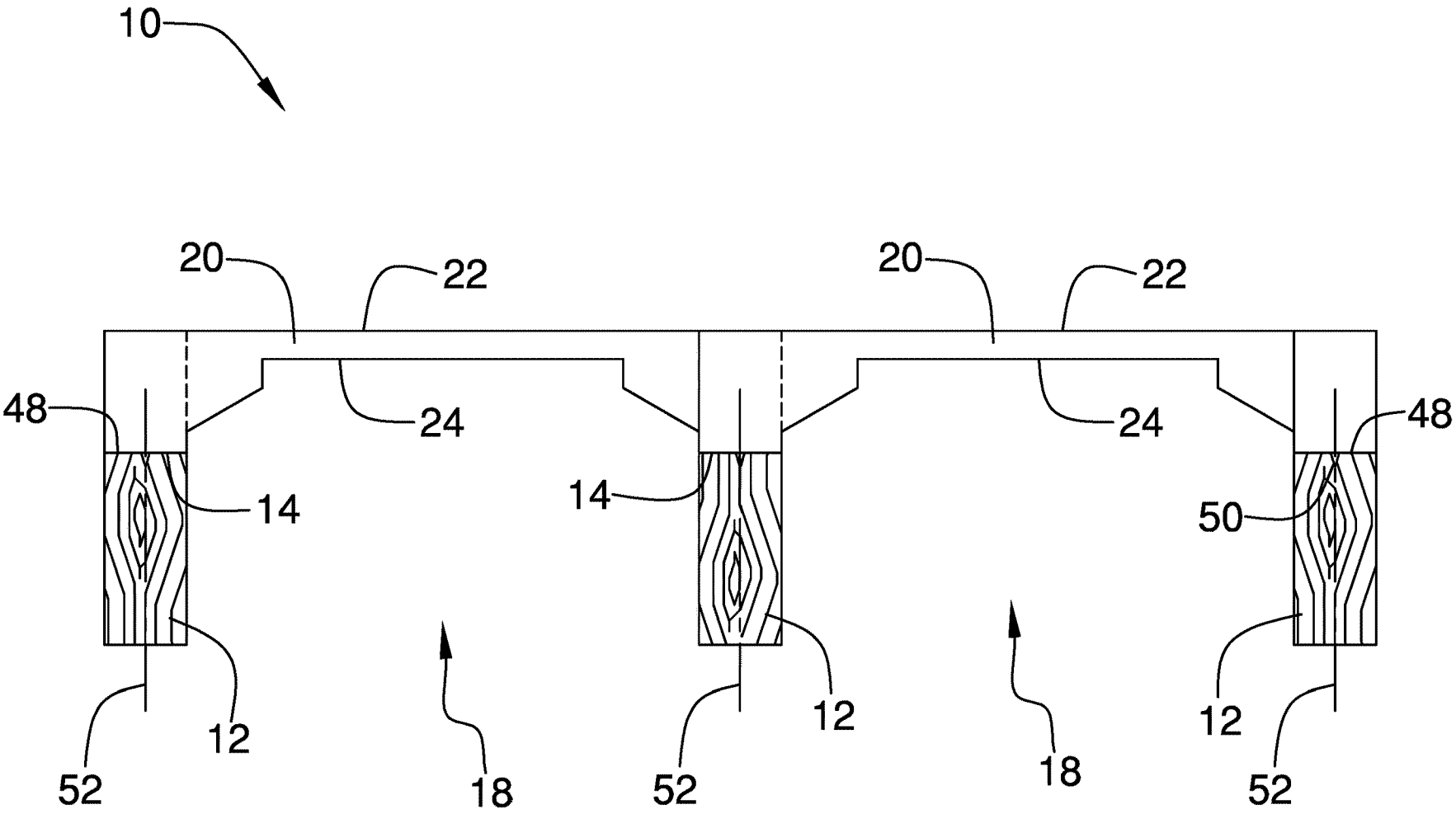
FIG. 6 is a side in-use view of an embodiment of the disclosure.

With reference now to the drawings, and in particular to FIGS. 1 through 6 thereof, a new attic walkway system embodying the principles and concepts of an embodiment of the disclosure and generally designated by the reference numeral 10 will be described.

As best illustrated in FIGS. 1 through 6, the modular attic walkway system 10 generally comprises a plurality of attic joists 12, wherein each of the attic joists 12 has a top face 14. Each of the attic joists 12 are typically spaced from each other either 16.00 inches or 24.00 inches as is standard in attic construction.

A plurality of platforms 16 is removably attached to the top faces 14 such that each of the platforms 16 traverses an open space 18 positioned between adjacent ones of the attic joists 12. Each of the platforms 16 is releasably interlocked with an adjacent one of the platforms 16. Each of the platforms 16 includes a panel 20 which has a top surface 22, a bottom surface 24, and a perimeter surface 26 extending between the top surface 22 and the bottom surface 24. The top surface 22 is textured to improve traction and prevent slipping when in use. The texture may be integral to the top surface 22, a textured coating attached to the top surface 22, or another layer applied to all or a portion of the top surface 22. The perimeter surface 26 includes a first mating edge 28, a second mating edge 30, a first lateral edge 32, and a second lateral edge 34. The first mating edge 28 and the second mating edge 30 are positioned opposite each other between 17.0 inches and 27.00 inches apart. The first lateral edge 32 and the second lateral edge 34 are positioned opposite each other between 14.00 and 24.00 inches apart. The top surface 22 and the bottom surface 24 are typically separated between 0.50 inch and 1.50 inches apart. The plurality of platforms 16 is made of a structurally rigid material capable of withstanding the force of a person carrying a light load across the plurality of platforms. Suitable materials may include rigid plastics, wood, metals, and the like.

The first mating edge 28 includes a tongue cutout 36 which extends inwardly from the first mating edge 28 toward the second mating edge 30. The tongue cutout 36 extends through the top surface 22 and the bottom surface 28. The tongue cutout 36 is positioned between the first lateral edge 32 and the second lateral edge 34. A pair of foot extensions 38 extends outwardly away from the first mating edge 28. The first lateral edge 32 and the second lateral edge 34 each abut one of the foot extensions 38. The first mating edge 28 includes a pair of foot notches 40 which extends inwardly from the first mating edge 28 toward the second mating edge 30. Each of the foot notches 40 extends through the top surface 22 and the bottom surface 24. Each of the foot notches 40 is positioned between the tongue cutout 36 and each of the foot extensions 38.

A tongue extension 42 extends outwardly away from the second mating edge 30 and releasably interlocks with an adjacent tongue cutout 36 of an adjacently positioned one of the panels 20. The tongue extension 42 releasably engages the adjacent tongue cutout 36 of the adjacent panel 20 such that the adjacently placed platform 16 is unable to laterally or longitudinally disengage from the second mating edge 30. The tongue extension 42 is positioned between the first lateral edge 32 and second lateral edge 34. A pair of foot protrusions 44 extends outwardly away from the second mating edge 30. Each of the foot protrusions 44 is positioned to extend into the foot notches 40 on the adjacently positioned one of the panels 20.

A plurality of legs 46 is attached to and extends downwardly from the bottom surface 24 and abuts a corresponding one of the top faces 14 of the attic joists 12. Each of the plurality of legs 46 has a bottom face 48. Each of the foot extensions 38 and each of the foot protrusions 48 has one of the plurality of legs 46 extending downwardly therefrom. Each of the plurality of legs 46 has a sufficient height to allow the platform 16 to span over any ducts, wiring, insulation, or other commonly found construction materials that may be found in the open space 18 between the attic joists 12. The legs 46 should have a height minimally equal to 2.00 inches. A plurality of securing tacks 50 is attached to and extends downwardly from the bottom faces 48 of the legs 46. Each of said plurality of legs 46 has at least one of said plurality of securing tacks 50. Each of the securing tacks 50 extends into one of the top faces 14 to removably secure the platform 16 to the top faces 14 of the attic joists 12. Each of the plurality of securing tacks 50 is positioned to align with a central axis 52 of an associated one of the attic joists 12. The lateral distance between the securing tacks 50 positioned on the legs 46 adjacent to the first mating edge 28 and those securing tacks 50 positioned on the legs 46 adjacent to the second mating edge 30 is either 16.00 inches or 24.00 inches apart, depending on which attic joist 12 spacing is used. Each of the securing tacks 50 extends away from each of the bottom faces 48 a distance between 0.125 inch and 0.5 inch.

A plurality of mounting apertures 54 extends vertically through the panel 20. Each of the mounting apertures 54 is configured to receive a fastener such that the fastener is extendable into one of the top faces 14 to secure the panel 20 to the attic joists 12. Each of the foot extensions 38 and each the foot protrusions 44 have one of the mounting apertures 54 extending therethrough. Each of the mounting apertures 54 is aligned with the associated one of the central axes 52 found on the associated attic joists 12. The fasteners used may include nails, screws, bolts, or any other conventionally used fasteners.

In use, the first of the plurality of platforms 16 is placed across the pair of attic joists 12 such that the securing tacks 50 are aligned with the central axis 52 of an associated one of the top faces 14 of the attic joists 12. The platform 16 is then pressed downwardly to seat the securing tacks 50. The fasteners may be inserted into each of the mounting apertures 54 and secured to permanently secure the first platform 16 to the attic joists 12 if desired.

The adjacently placed one of the plurality of platforms 16 is positioned adjacent to the first platform 16 orientated such that the adjacent tongue cutout 36 is interlockable with the tongue extension 42 of the first platform 16. The adjacent platform 16 is pressed downwardly into place with the adjacent tongue cutout 36 engaged with the tongue extension 42 of the platform 16. The adjacently placed one of the platforms 16 may then be permanently secured using the fasteners through the mounting apertures 54 of the adjacent platform. Additional platforms 16 may be added using the same process described for the adjacent platform 16 until the desired length of walkway has been placed and secured. When not in use, the plurality of panels 20 are stackable.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A modular walkway system for creating a walkway across a plurality of attic joists, said system including:

a plurality of attic joists each having a top face;

a plurality of platforms being removably attached to said top faces such that each of said platforms traverses an open space positioned between adjacent ones of said attic joists, each of said platforms being releasably interlocked with an adjacent one of said platforms, each of said platforms comprising:

a panel having a top surface, a bottom surface, and a perimeter surface extending between said top surface and said bottom surface, said perimeter surface including a first mating edge, a second mating edge, a first lateral edge, and a second lateral edge;

said first mating edge including a tongue cutout extending inwardly from said first mating edge toward said second mating edge;

a tongue extension extending outwardly away from said second mating edge and releasably interlocking with an adjacent tongue cutout of said adjacently positioned one of said panels;

a pair of foot extensions extending outwardly away from said first mating edge, said first lateral edge and said second lateral edge each abut one of said foot extensions;

said first mating edge including a pair of foot notches extending inwardly from said first mating edge toward said second mating edge;

a pair of foot protrusions extending outwardly away from said second mating edge;

a plurality of legs being attached to and extends downwardly from said bottom surface and abuts a corresponding one of said top faces of said attic joists, each of said plurality of legs has a bottom face; and each of said foot extensions and said foot protrusions having one of said plurality of legs extending downwardly therefrom.

2. The system for creating a walkway across a plurality of attic joists according to claim 1, wherein said first mating edge and said second mating edge are positioned opposite each other.

3. The system for creating a walkway across a plurality of attic joists according to claim 1, wherein said tongue cutout extends through said top surface and said bottom surface.

4. The system for creating a walkway across a plurality of attic joists according to claim 1, wherein said tongue cutout is positioned between said first lateral edge and said second lateral edge.

5. The system for creating a walkway across a plurality of attic joists according to claim 1, wherein each of said foot notches extends through said top surface and said bottom surface.

6. The system for creating a walkway across a plurality of attic joists according to claim 1, wherein each of said foot notches is positioned between said tongue cutout and each of said foot extensions.

7. The system for creating a walkway across a plurality of attic joists according to claim 1, wherein said tongue extension releasably engages said adjacent tongue cutout of said adjacent panel such that said adjacent platform is unable to laterally or longitudinally disengage from said second mating edge.

8. The system for creating a walkway across a plurality of attic joists according to claim 1, wherein said tongue extension is positioned between said first and second lateral edges.

9. The system for creating a walkway across a plurality of attic joists according to claim 1, wherein each of said foot protrusions is positioned to extend into said foot notches on said adjacently positioned one of said panels.

10. The system for creating a walkway across a plurality of attic joists according to claim 1, wherein a plurality of securing tacks is attached to and extends downwardly from each of said bottom faces of said legs, each of said securing tacks extends into one of said top faces to removably secure said platform to said top faces of said attic joists, each of said plurality of securing tacks is positioned to align with a central axis of an associated one of said attic joists.

11. The system for creating a walkway across a plurality of attic joists according to claim 10, wherein each of said securing tacks extends away from each of said bottom faces a distance between 0.125 inch and 0.5 inch.

12. The system for creating a walkway across a plurality of attic joists according to claim 1, wherein a plurality of mounting apertures extends vertically through said panel, each of said mounting apertures being configured to receive a fastener such that the fastener is extendable into one of said top faces to secure said panel to said attic joists, each of said foot extensions and each said foot protrusions having one of said mounting apertures extending therethrough, each of said mounting apertures being aligned with said associated one of said central axis.

13. The system for creating a walkway across a plurality of attic joists according to claim 1, wherein said top surface is textured to improve traction.

14. A modular walkway system for creating a walkway across a plurality of attic joists, said system including:

a plurality of attic joists each having a top face;

a plurality of platforms being removably attached to said top faces such that each of said platforms traverses an open space positioned between adjacent ones of said attic joists, each of said platforms being releasably interlocked with an adjacent one of said platforms, each of said platforms comprising:

a panel having a top surface, a bottom surface, and a perimeter surface extending between said top surface and said bottom surface, said top surface being textured to improve traction, said perimeter surface including a first mating edge, a second mating edge, a first lateral edge, and a second lateral edge, said first mating edge and said second mating edge being positioned opposite each other;

said first mating edge including a tongue cutout extending inwardly from said first mating edge toward said second mating edge, said tongue cutout extending through said top surface and said bottom surface, said tongue cutout being positioned between said first lateral edge and said second lateral edge;

a pair of foot extensions extending outwardly away from said first mating edge, said first lateral edge and said second lateral edge each abutting one of said foot extensions;

said first mating edge including a pair of foot notches extending inwardly from said first mating edge toward said second mating edge, each of said foot notches extending through said top surface and said bottom surface, each of said foot notches being positioned between said tongue cutout and each of said foot extensions;

a tongue extension extending outwardly away from said second mating edge and releasably interlocking with an adjacent tongue cutout of said adjacently positioned one of said panels, said tongue extension releasably engaging said adjacent tongue cutout of said adjacent panel such that said adjacent platform is unable to laterally or longitudinally disengage from said second mating edge, said tongue extension being positioned between said first and second lateral edges;

a pair of foot protrusions extending outwardly away from said second mating edge, each of said foot protrusions being positioned to extend into said foot notches on said adjacently positioned one of said panels;

a plurality of legs being attached to and extending downwardly from said bottom surface and abutting a corresponding one of said top faces of said attic joists, each of said plurality of legs having a bottom face, each of said foot extensions and said foot protrusions having one of said plurality of legs extending downwardly therefrom;

a plurality of securing tacks being attached to and extending downwardly from each of said bottom faces of said legs, each of said securing tacks extending into one of said top faces to removably secure said platform to said top faces of said attic joists, each of said plurality of securing tacks being positioned to align with a central axis of an associated one of said attic joists, each of said securing tacks extending away from each of said bottom faces a distance between 0.125 inch and 0.5 inch; and a plurality of mounting apertures extending vertically through said panel, each of said mounting apertures being configured to receive a fastener such that the fastener is extendable into one of said top faces to secure said panel to said attic joists, each of said foot extensions and each said foot protrusions having one of said mounting apertures extending therethrough, each of said mounting apertures being aligned with said associated one of said central axis.

* * * * *